United States Patent [19]

Frohlich et al.

[11] 4,189,886

[45] Feb. 26, 1980

[54] VENTILATED INSULATED ROOFING SYSTEM

[75] Inventors: Robert T. Frohlich, Bedford; John L. Wright, Duxbury; Bruce A. Blessington, Bolton, all of Mass.

[73] Assignee: W. R. Grace & Co., Cambridge, Mass.

[21] Appl. No.: 658,145

[22] Filed: Feb. 13, 1976

Related U.S. Application Data

[60] Continuation of Ser. No. 484,818, Jul. 1, 1974, abandoned, which is a division of Ser. No. 409,849, Oct. 26, 1973, Pat. No. 3,884,009.

[51] Int. Cl.[2] ..... E04B 1/16; E04B 1/20

[52] U.S. Cl. ..... 52/302; 52/310

[58] Field of Search ..... 52/302, 310, 309

[56] References Cited

U.S. PATENT DOCUMENTS

| | | | |
|---|---|---|---|
| 1,562,427 | 11/1925 | Waller | 52/673 |
| 2,007,148 | 7/1935 | White . | |
| 2,990,027 | 6/1961 | Sabine . | |
| 3,135,069 | 6/1964 | Schuller | 52/411 |
| 3,295,278 | 1/1967 | Muhm . | |
| 3,304,678 | 2/1967 | Morell . | |
| 3,438,161 | 4/1969 | Koch . | |
| 3,455,076 | 7/1969 | Clarvoe . | |
| 3,498,015 | 3/1970 | Seaburg . | |
| 3,551,270 | 12/1970 | Sharkey . | |
| 3,598,688 | 8/1971 | Bellamy . | |
| 3,619,961 | 11/1971 | Sterrett | 52/302 |
| 3,763,614 | 10/1973 | Hyde . | |
| 3,809,600 | 5/1974 | Larson . | |
| 3,814,208 | 6/1974 | Morresi . | |
| 3,832,264 | 8/1974 | Barnette . | |

FOREIGN PATENT DOCUMENTS

| | | | |
|---|---|---|---|
| 1901744 | 8/1970 | Fed. Rep. of Germany | 52/198 |
| 1965839 | 9/1971 | Fed. Rep. of Germany . | |

*Primary Examiner*—John E. Murtagh

*Attorney, Agent, or Firm*—William L. Baker; C. Edward Parker

[57] ABSTRACT

Moisture entrapped within roofing systems of the type wherein a layer of normally low-permeance, cellular plastic insulation board (e.g. foamed polystyrene) is employed in conjunction with at least one layer of moisture-bearing construction material (e.g. lightweight insulating vermiculite concrete) is made able to be vented from within the system by providing the board with a plurality of openings therethrough and further preventing the fluid construction material when placed upon the board from entering and filling the openings. Such prevention of filling of the openings may be accomplished by making the dimension of the openings such that the fluid construction material will not flow therein yet moisture will pass, or by covering the openings with a material (e.g. paper) which will prevent such filling, the material however being permeable by any moisture later entrapped within the roofing system.

1 Claim, 8 Drawing Figures

FIG. 3
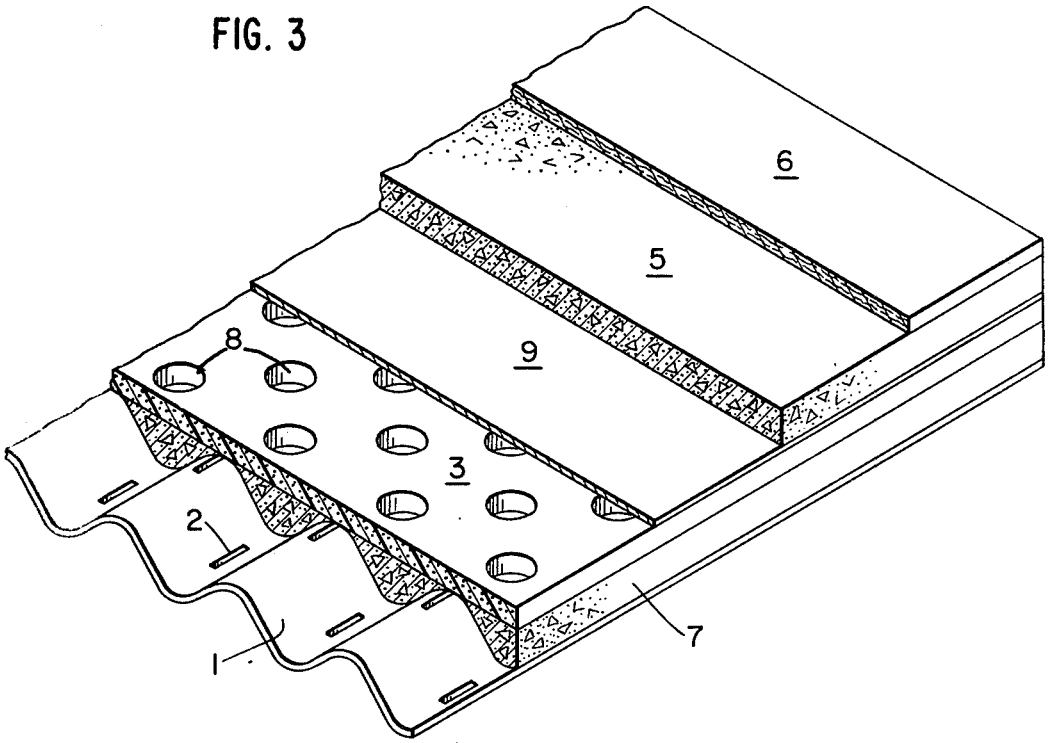
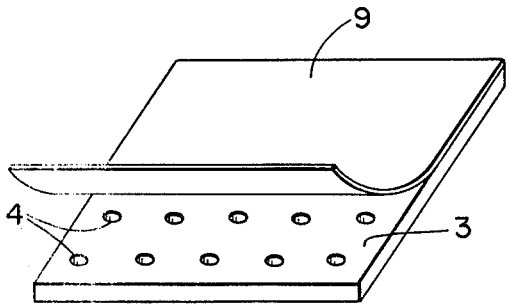
FIG. 4
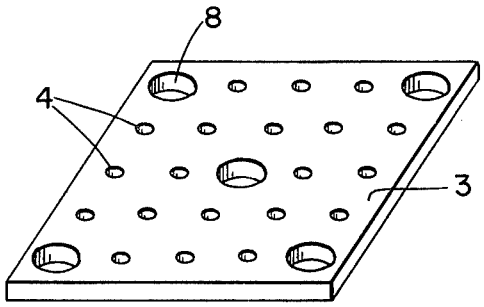
FIG. 5

VENTILATED INSULATED ROOFING SYSTEM

This is a continuation, of application Ser. No. 484,818 filed July 1, 1974 now abandoned which is a division of Application U.S. Ser. No. 409,849 filed Oct. 26, 1973, now U.S. Pat. No. 3,884,009.

BACKGROUND OF THE INVENTION

This invention relates to improved ventilated insulated roofing systems. More particularly, this invention concerns roofing systems which employ as the insulation medium, or as a part of the insulation medium, a layer of normally low-permeance cellular plastic material such as foamed polystyrene, which systems are improved with respect to the ability to vent or release moisture entrapped within.

Insulation boards comprised of a normally low-permeance, that is, usually less than about 3 to 5 perms, cellular synthetic resinous material such as foamed or expanded polystyrene, polyurethane, etc., have been widely employed as a thermal insulation medium in roofing systems, especially systems wherein the various components are installed or "built-up" at the job site. For instance, in U.S. Pat. No. 3,094,477 there is described a method of preparing a built-up roof wherein a board of foamed polystyrene is adhered to the structural deck and several layers of a bitumen and felt are applied above to provide the waterproofing membrane. One serious problem associated with the use of such low-permeance boards in the roofing is the entrappment of moisture vapor beneath the impermeable waterproofing. Such moisture vapor, especially on hot days, can cause the formation of bubbles and subsequent leaks in the bituminous waterproofing membrane.

The problem of moisture entrappment can be of all the more concern in roofing systems such as that described in U.S. Pat. No. 3,619,961 to Sterret et al wherein a layer of the foamed insulation board is employed in conjunction with a layer, more often a number of layers, of a moisture-bearing material such as lightweight insulating concrete. The foamed board enhances the thermal insulation of the system without adding appreciably to the weight of the roof. The insulating concretes are generally mixtures of Portland cement and a lightweight aggregate such as expanded vermiculite or perlite, fly ash, etc. Whereas, the water to cement ratio for structural Portland cement concretes lies generally between 0.4 and 0.7, a typical water to cement ratio for such lightweight insulating concretes ranges in excess of 2. This excess mix water employed to render the material sufficiently fluid for placement can easily become entrapped beneath the waterproofing in these systems by the impermeable foam. In the Sterrett et al patent, the problem of venting such entrapped moisture is solved by grooving a number of the lateral surfaces of the plastic foam insulation board which act to convey the moisture around the board and eventually outside the roofing system. In another previous system wherein the foamed insulation board has been "sandwiched" between two layers of lightweight insulating concrete, holes have been provided through the layer of foam insulation and the fluid concrete from the upper layer allowed to flow into and fill up the openings. In this system, the "bridges" of concrete formed in the foam layer serve chiefly to key the upper layer of concrete to the lower layer and as passageways for moisture since the concrete itself is moisture permeable.

SUMMARY OF THE INVENTION

While the aforementioned previous systems have met successful commercial acceptance, there remains a need for a more efficient manner of venting moisture entrapped in roofing systems of this type. In the present invention, it has been found that highly efficient venting of moisture entrapped within a roof system wherein at least one layer of moisture bearing construction material such as lightweight insulating concrete is employed in conjunction with a layer of normally impermeable cellular plastic insulation board, is obtained by providing a number of openings extending through the board of a dimension selected such that passage of moisture therethrough is allowed, and thereafter insuring that the openings are not penetrated and filled by the layer of construction material. Thus in the present system, there is provided a direct, unobstructed passage for flow of moisture through the cellular insulation.

Filling of the openings in the cellular board by the moisture bearing construction material is prevented according to one embodiment of the invention by proper dimensioning of the opening at the face of the board upon which the construction material is to be placed. In this embodiment, the opening at such face is dimensioned such that passage of moisture therethrough is permitted yet fluid construction material such as insulating concrete is prevented from substantially filling the opening. The precise geometrical shape selected for the opening is not critical and any desired shape may be employed so long as the construction material is prevented from filling the openings. Preferably, the opening will have at least one cross-wide dimension not exceeding about 0.37 inch. Thus for openings of circular configuration for example, the crosswise dimension or diameter should not exceed about 0.37 inch in order to prevent filling thereof. In a preferred embodiment of the invention the openings are made to have an elongated, generally rectangular slot-like configuration approximately 0.25 inch wide by approximately 2.25 inches long. The total open area calculated as a percentage of the area of the surface of the board, should be at least great enough to allow drying of the wet construction material within a season. Generally, an open area equivalent to at least 0.5 percent of the total surface area of the board should be used. A board having an open area above about 50 percent of the surface of the board is mechanically weak and has a significantly reduced insulation value. It is preferred that the total open area of the board fall within from about 1 to 4, more preferably about 2 to 3 percent of the surface area of the board.

Prevention of the filling up of the openings by the fluid construction material applied over the board is accomplished in another embodiment of the invention by providing a layer of a moisture-permeable material such as paper over the openings before the fluid material is applied. In this embodiment, the maximum size of the openings is not critical as in the above embodiment since the permeable material will prevent the filling of the openings. The material, because of its permeability will however pass moisture therethrough to the openings. Any moisture permeable material having the requisite strength to prevent the concrete from entering the openings may be used for this purpose. In addition to paper, specific examples include woven and non-woven fibrous materials of glass, cloth or synthetic resinous material such as nylon.

BRIEF DESCRIPTION OF THE DRAWINGS

In the attached drawings:

FIGS. 1–3 are perspective views, partially in section of roofing installations according to various embodiments of the invention;

FIGS. 4–7 are perspective views showing various alternative insulation board constructions for use in the systems of FIGS. 1–3;

DESCRIPTION OF THE PREFERRED EMBODIMENT

Figure 1:
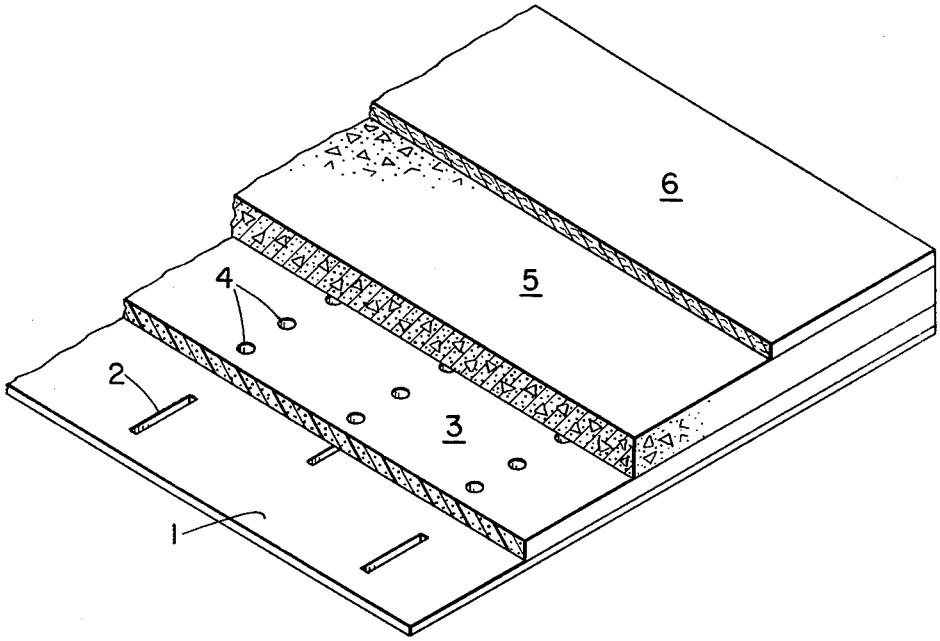
Figure 2:
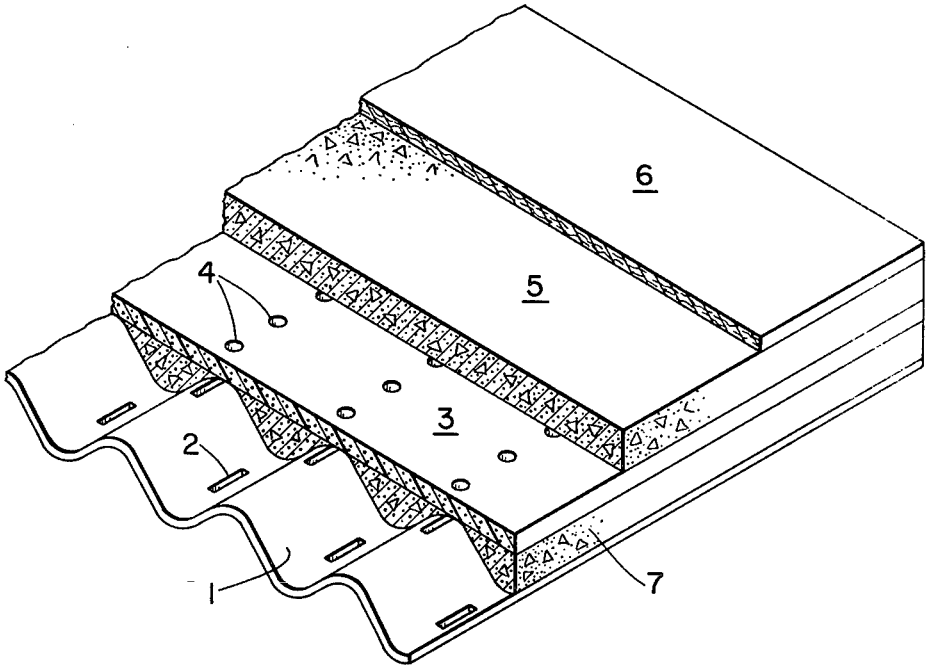

Referring now specifically to FIG. 1 of the drawings, subdeck 1, which is typically comprised of substantially rigid galvanized steel sheeting often corrugated or formed as shown in FIG. 2, is secured to and supported by structural frame members (not shown) and has apertures 2 therethrough to provide an egress for moisture to the atmosphere below. Subdeck 1 can of course, be composed of a material other than metal, e.g. wood or structural concrete, and also may be planar instead of corrugated or formed. A layer of normally-impermeable foamed polystyrene board 3 is placed adjacent the metal deck. The thickness of the board is generally from one half to 4 inches. The board shown in FIG. 1 has circular openings 4 therethrough having an approximate diameter of about 0.25 inch. Layer 5 of expanded vermiculite-Portland cement lighweight insulating concrete is cast while in a fluid, plastic state over the board 3 in a thickness of from about 2 to 8 inches. Because of the relatively small size of openings 4, the fluid concrete does not fill the openings. After sufficient hardening of the concrete layer 5, a layer 6 of waterproofing material, for example bitumen and felt, is applied. Excess moisture from the concrete layer 5 is permitted direct passage through the board 3 and out through openings 2 because of the void spaces 4 maintained in the board. As an alternate or additional method to the use of openings 2 for conducting the moisture out of the roofing system, an air-space or air spaces between layer 5 and waterproofing 6 can be provided for, and such made to communicate with the atmosphere outside of waterproofing 6. One method of accomplishing this is to place a layer of felt having particles of for example, gravel embedded therein, adjacent the surface of layer 5 beneath the waterproofing. The particles prevent full contact of the felt with the surface of layer 5 and thereby provide air spaces which act as channels for passage of moisture from layer 5. These channels in turn can be vented through the waterproofing to the atmosphere for example, by placing one or more conventional roof vents through the waterproofing and into the layer of channels.

In FIG. 2, an additional layer 7 of lightweight insulating concrete is first applied to the corrugated subdeck 1 and the concrete screeded to the height of the corrugations so that essentially only the valleys of the corrugations are filled. The layer 7 of insulating concrete provides a flat surface for the board 3 and also provides additional thermal insulation to the finished roofing structure. Ideally, a number of the openings 4 will become aligned with the apertures 2 in the subdeck for direct venting of moisture, but this is not necessary since the concrete itself is moisture permeable.

In FIG. 3, the openings 8 are of relatively larger size than openings 4, for example, of at least about 0.5 and preferably from about 1.5 to about 3 inches in a crosswise dimension. Since the plastic concrete layer 5 would normally fill up openings of such dimension, a layer of permeable Kraft paper 9 is provided between the board 3 and the concrete 5 to prevent the concrete from entering the openings. Since the paper is permeable by moisture it will permit the passage thereof into the voids 8. If desired, the insulation board 3 of FIG. 1 having the smaller diameter holes 4 therein can be provided with a layer of paper (shown in FIG. 4) to insure that the voids 4 are not completely filled during the placement of the concrete layer 5.

In FIG. 5, there is shown an insulation board useful in the roofing system of the invention wherein the board 3 has both openings 4 dimensioned as in FIGS. 1 and 2 and the larger openings 8 dimensioned as in FIG. 3. When employed in the systems shown in FIGS. 1 and 2, a portion of the concrete from layer 5 will fill the larger sized openings 8 but not the openings 4. Bridges of concrete are thus formed in the openings 8 which in the arrangement of FIG. 1 would provide additional support to the upper layer of concrete 5 when workers installing the waterproofing 6 walk on it. A further advantage obtained is that the bridges serve to key the upper layer of concrete to the foam 7 thereby enhancing the resistance of the upper layers to lifting by abnormally high winds. The resistance to lifting would be especially improved by the use of the board of FIG. 5 in the system of FIG. 2 since the upper concrete layer would not only be keyed to the foam but also to the lower layer of concrete 7. A further advantage offered by the formation of such bridges of concrete in the foam is that in the event a fire below the roofing reaches an intensity sufficient to burn out the foam layer, the bridges assist in maintaining the integrity of the roofing system.

Figure 6:
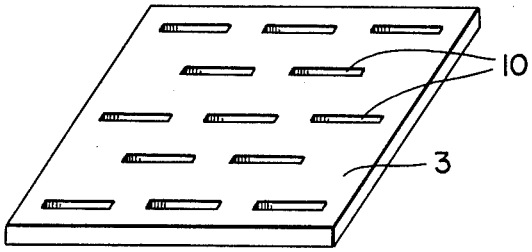
Figure 7:
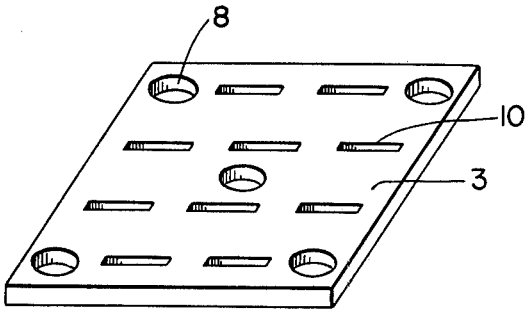
Figure 8:
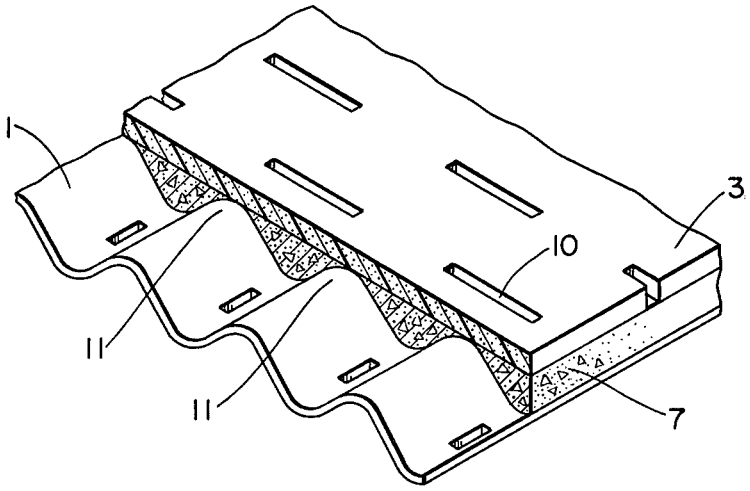
FIG. 8 is a perspective view, partially in section, of a roofing system employing the board of FIG. 6.

In the embodiment shown in FIG. 6, the openings in the insulation board have an elongated, generally slot-like configuration about 0.25 by 2.25 inches. The openings are preferably staggered as shown. Because of the relatively narrow width of the slots, the concrete will not fill up the openings when poured. The use of openings having this configuration minimizes the opportunity for blockage of the opening as a result of the opening being aligned directly over an imperforate portion of the metal subdeck. For example, in FIG. 8, the board of FIG. 6 is shown installed in a system having a corrugated metal subdeck, the board being placed such that the openings 10 extend longitudinally at an angle to the lengthwise direction of the corrugations. The use of the slot configuration in this instance has an advantage over for instance circular openings, in that assurance is obtained that the opening will not be entirely blocked off by alignment over an imperforate portion of the apex 11 of the corrugation. The slotted board may also be provided with the large diameter openings 8 as shown in FIG. 7 to permit the formation of bridges of concrete through the board as described above.

The insulation board of the invention is as aforementioned preferably comprised of foamed polystyrene, especially foamed polystyrene board often called "bead board" prepared by molding expandable particles or beads of polystyrene in a closed cavity. The heat employed in the molding operation expands and fuses the particles into a lightweight, cellular, relatively rigid board. Cellular plastic boards wherein the plastic particles are alternatively or additionally bonded by a method other than fusion, for example by a latex or a hydraulic cement such as Portland cement binder, are within the scope of the present invention.

The openings in the polystyrene board can be cut through the board in any desired manner. For instance, the openings may be cut, bored or melted in an already formed board. Alternatively, they may be formed by placing appropriate sized dead-heads in the board molding equipment.

It is claimed:

1. A ventilated, insulated roof comprising (a) a subdeck of substantially rigid metal sheeting having apertures therethrough for permitting passage of moisture; (b) a first layer of fluid moisture-bearing construction material over the metal subdeck; (c) a layer comprising a plurality of normally low-permeance insulation boards having upper and lower surfaces and comprised of cellular plastic material selected from the group consisting of foamed polystyrene and foamed polyurethane, said boards further having a plurality of openings therethrough, each said opening extending vertically from said upper surface through the body of said board to said lower surface so that each opening is surrounded by said cellular plastic material, all of said openings being dimensioned sufficiently to pass moisture therethrough, certain of said openings having a widthwise dimension of up to about 0.37 inch in order to prevent fluid, moisture-bearing construction material poured thereon at the job site from entering and substantially filling such openings, other of said openings being from about 1.5 to about 3 inches in a crosswise dimension in order that said construction material will flow into and substantially fill them and thus provide bridges of said construction material to be formed through said board; (d) a second layer of said fluid construction material extending over and in contact with the said upper surfaces of said boards, said second layer of fluid material extending into and substantially filling said openings having a crosswise dimension of from about 1.5 to about 3 inches but not substantially extending into the said openings having a widthwise dimension of up to about 0.37 inch; and (e) a surface layer of waterproofing material above said second layer of construction material, whereby moisture from said second layer of construction material can be directly vented through the vacant openings maintained in said boards, through said first layer of construction material and out said apertures in said metal sheeting.

* * * * *